United States Patent [19]

Justman

[11] 4,280,742

[45] Jul. 28, 1981

[54] WALL CONTACTING TOOL

[75] Inventor: Daniel B. Justman, Houston, Tex.

[73] Assignee: Smith International, Inc., Newport Beach, Calif.

[21] Appl. No.: 131,449

[22] Filed: Mar. 18, 1980

Related U.S. Application Data

[63] Continuation of Ser. No. 944,639, Sep. 21, 1978, abandoned.

[51] Int. Cl.[3] ..... F16C 29/02

[52] U.S. Cl. ..... 308/4 A; 166/241

[58] Field of Search ..... 308/4 A, 4 R, DIG. 11; 166/241; 175/325, 346, 345, 347

[56] References Cited

U.S. PATENT DOCUMENTS

| | | | |
|---|---|---|---|
| 2,189,040 | 2/1940 | Jones | 175/346 |
| 3,454,308 | 7/1969 | Kennedy | 166/241 |
| 3,818,999 | 6/1974 | Garrett | 175/325 |
| 4,013,325 | 3/1977 | Rear | 175/325 |
| 4,138,168 | 2/1979 | Herlitzek | 308/DIG. 11 |

*Primary Examiner*—Lenard A. Footland

*Attorney, Agent, or Firm*—Murray Robinson; Ned L. Conley; David Alan Rose

[57] ABSTRACT

A wall contacting tool, such as a fixed blade rotating stabilizer, useful in earth boring has replaceable wear pads. Each pad is of generally sector shape cross section, the pad corner having a 90° apex angle and fitting in a correlative V groove flute at the end of an arm of the stabilizer body, being held in place by radial dowel pins each bisecting the apex angle of the corner and flute. Each pin has a head turned to be retained in a slot in the body and having a threaded socket receiving a cap screw whose head engages an outwardly facing shoulder in a stepped hole in the pad. The pad corner above and below the dowel pin locks the dowel pin head against turning. A releasable retainer ring in an annular groove in the stepped hole prevents withdrawal of the cap screw from the pad. A lateral dowel inbetween one side of the pad corner and one side of the body flute prevents movement of the pad radially outwardly from the flute.

7 Claims, 10 Drawing Figures

WALL CONTACTING TOOL

This is a continuation of application Ser. No. 944,639 filed Sept. 21, 1978, abandoned.

BACKGROUND OF THE INVENTION

This invention relates to wall contacting tools useful in earth boring, especially by the rotary system, and more particularly to a fixed blade, rotating stabilizer whose wall contacting elements are in the form of replaceable wear pads.

In U.S. Pat. No. 3,680,647—Dixon and Crews, there is disclosed a wall contacting tool, specifically a fixed blade stabilizer, having replaceable wear pads of approximately sector shape cross section. The corner of each pad is received in a correlative V groove flute in the outer periphery of an arm of the tubular body of the stabilizer. The pad corner and flute apex angle is ninety degrees. The pad is secured to the body by a plurality of cap screws extending laterally through the pad into the two sides of the flute. Various prior United States patents referred to in the patent are numbered:

U.S. Pat. Nos. 3,454,308—Kennedy;
2,084,421—Wright;
2,973,996—Self;
3,292,708—Mundt;
2,088,770—Skinner;
2,589,534—Buttolph.

The Kennedy, Wright and Self patents show various forms of wall contacting tools with wall contacting elements secured to the body by radially extending screws. Various and other forms of retention are shown in the Skinner, Mundt and Buttolph patents. Reference also may be made to U.S. Pat. Nos. 3,326,305—Garrett, 3,545,825—Hamilton, which are referred to in U.S. Pat. No. 3,818,999—Garrett.

In U.S. Pat. No. 3,818,999—Garrett, there is disclosed a stabilizer having wear pads of generally sector shape cross section, each disposed in a correlative 90° angle V groove or flute in the stabilizer body. Each pad is held in place by dowel pins in the apex of the wear pad corner and body flute, the dowel pins preventing lateral movement of the pad. Each dowel pin has a head anchoring it to the body. Each dowel pin has a screw receiving socket and thus constitutes a nut, such nut receives a cap screw extending through a stepped bore in the pads to hold the pad to the body. Because there are a plurality of dowel pin-nuts for each wear pad, the dowel pin function of the dowel pin-nuts is less effective. This is by reason of the sloppy fit between the dowel pin-nuts and the bores of the pads and body in which they are received, as required to insure that the parts will fit together when made to reasonable tolerances. Because of the sloppy fit, shear loads are not confined to the dowel pin-nuts; the shear loads are transferred in large measure to the cap screws.

For the foregoing reason and perhaps others, the assembly can be loosened in use by excessive force, e.g. in directions parallel to the stabilizer axis (hereinafter referred to as axial force) caused, e.g. by the stabilizer, during a trip, passing through a tight place in the earth bore, causing the cap screws to be stretched beyond their elastic limit, or by excessive torque on the wear pads, due, e.g. to turning in a tight bore or while heavily pressed laterally against the side of the well bore, causing the cap screws to be stretched beyond their elastic limit, or by excessive vibration during rotation in the bore, causing the cap screws to turn relative to their nuts and work loose, or by normal vibration causing improperly tightened cap screws to come loose, or by obstructing material such as dirt or metal burrs at the mating surfaces of the assembly disappearing or reducing in size under the repeated stresses occurring when the stabilizer is in use, thus loosening the cap screws.

When the assembly is loose, the cap screws may fall out, the loose pad may break and fall off, the dowel pin-nuts may drop out, and the stabilizer body may be damaged by the movement of the loose pad relative to the body.

It is the object of the invention to overcome the aforementioned difficulties. It has heretofore been suggested that a retainer ring might be placed over the head of each cap screw, disposed in a groove in the wear pad. However, this does not prevent the cap screws from turning, for the wear pad can move with the cap screws away from the stabilizer body as the cap screws turn in the dowel pin-nuts.

SUMMARY OF THE INVENTION

According to the invention the assembly comprising the stabilizer body, cap screws and radial dowel pin-nuts, described in the aforementioned Garrett patent, is provided both with retainer rings set in the wear pads over the heads of the cap screws and with a lateral dowel pin extending between one side of each wear pad and the adjacent side of the V groove in the stabilizer body in which the pad is mounted. This is possible by virtue of the V groove having substantially a ninety degree apex angle. With the undowelled side of a pad bearing against the correlative side of the V groove, the pad can be assembled to the body by sliding side ways into position. The lateral dowel pin registers with the socket in the other side of the pad or the other side of the V groove, the dowel pin having been initially inserted in a socket in either the pad or the body. After each pad is slid into position to engage the dowel pin in its side, the cap screws are screwed into the dowel pin-nuts in the apices of the pad and V groove and the retainer rings are installed over the heads of the cap screws.

It will be seen that the foregoing arrangement prevents the cap screws from coming out of the assembly, even if loosened, since the lateral dowel pin in each pad prevents relative movement of the pad and body in the direction of the cap screw axes and the retainer rings prevent relative axial movement of the cap screws and pad. According to the invention there is thus provided a positive lock retaining the wear pad to the body of the stabilizer. The lateral dowel pin also provides additional strength to the assembly in resisting axial forces and torque imposed on the pads. If, as is preferable, only one lateral dowel pin is used per pad, it can be made to have a tight fit with its sockets, since it is unnecessary to maintain any dowel pin separation (spacing) dimension, there being only one lateral pin per pad.

BRIEF DESCRIPTION OF THE DRAWING

For a more detailed description of a preferred embodiment of the invention, reference will now be made to the accompanying drawings wherein.

DESCRIPTION OF PREFERRED EMBODIMENT

Figure 1:
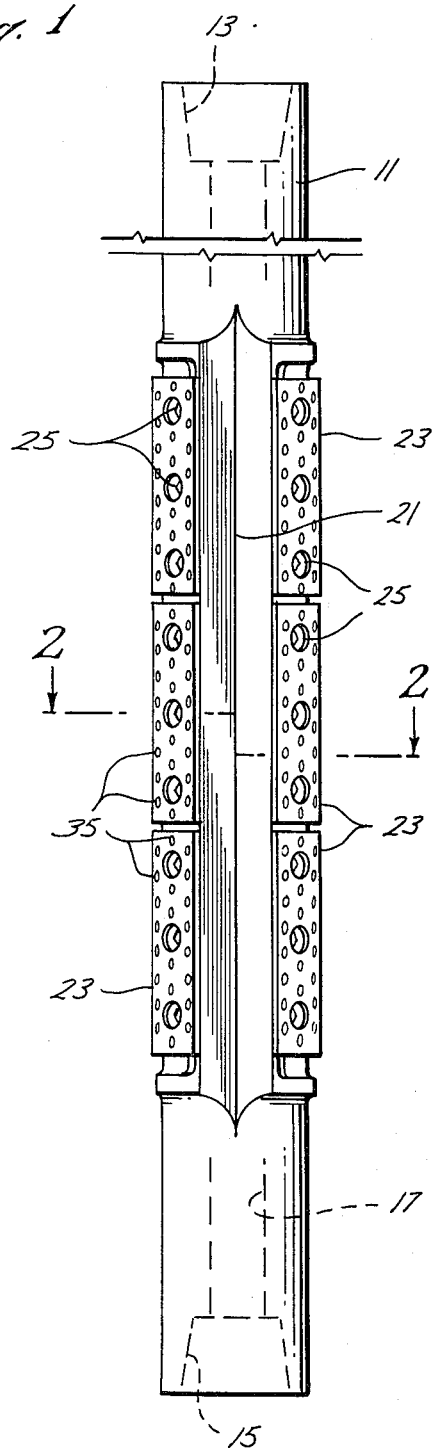
FIG. 1 is an elevation of a stabilizer embodying the invention.

Referring now to FIG. 1 there is shown a stabilizer comprising a tubular body 11 having a threaded tool joint box 13 at its upper end for making connection to a portion of a drill string thereabove and a tool joint box 15 at its lower end for making connection with a drill bit. The tool could be modified by putting other types of connectors at its ends, e.g. to adapt the stabilizer for use higher up in the drill string, a tool joint pin could be put at the lower end of the tool, providing means for making connection with a portion of the drill string thereabove. The body has an axial flow passage 17 extending from end to end thereof.

The body is provided with a plurality, e.g. four, as shown, of longitudinally extending ribs or arms or blades, equiazimuthally spaced apart about the axis of the body. The channels 21 formed between the arms provide axial flow passages over the exterior of the body.

Releasably secured to each arm are a plurality of wear pads 23. If desired, the upper and lower ends of the ribs can be protected by wear pads welded thereto; this is shown in the published description of the commercial embodiment of the previously known stabilizer upon which the present stabilizer is an improvement. Such description appears at pages 2142–2144 of the 1976–77 edition of the Composite Catalog of Oil Field Equipment & Services copyright 1976 by Gulf Publishing Company, to which reference may be made for further details. However such supplemental pads are not essential; see the leaflet entitled "Drilco's Replaceable Wear Pad Stabilizer" published by applicant's assignee, copy enclosed with this application.

Each pad 23 is held in place by means including at least one cap screw 25, three per pad being shown in FIG. 1.

Figure 2:
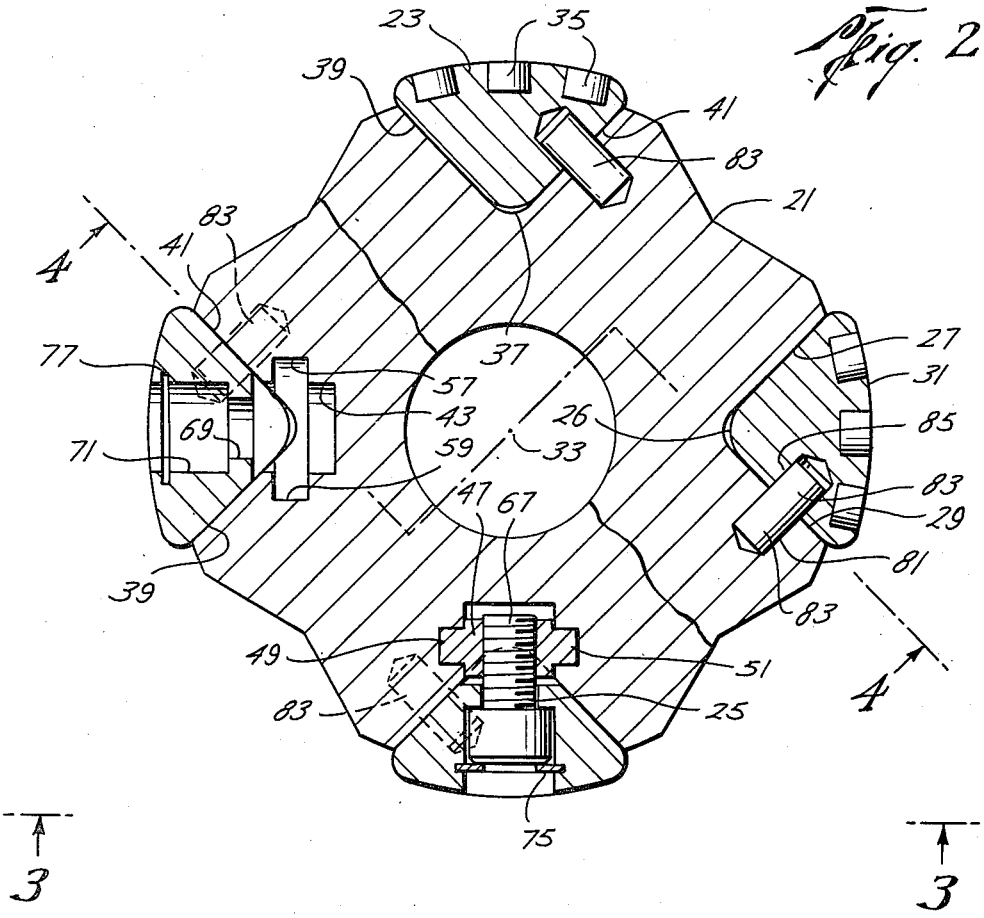
FIG. 2 is a section taken at planes 2—2 of FIG. 1.
Figure 5:
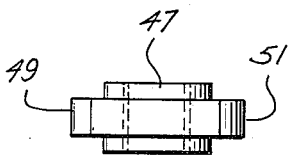
FIGS. 5 and 6 are respectively side and front views of a dowel pin-nut used in the stabilizer.
Figure 7:
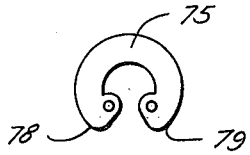
FIGS. 7 and 8 are respectively front and side views of a retainer ring used in the stabilizer.
Figure 9:
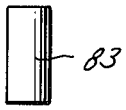
FIGS. 9 and 10 are side and end views of a lateral dowel pin used in the stabilizer.
Figure 3:
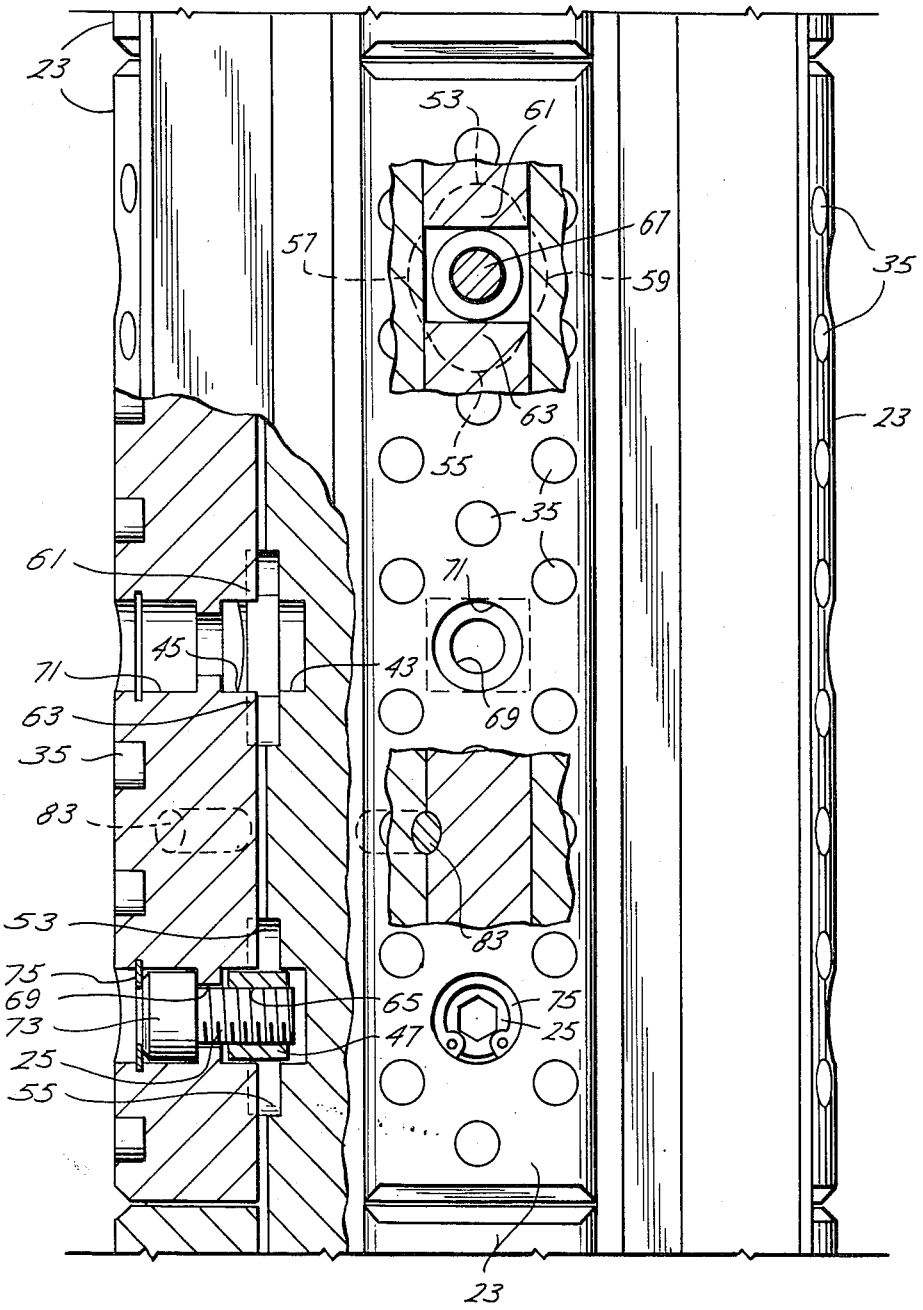
FIG. 3 is a fragmentary elevation viewed from plane 3—3 of FIG. 2, partly in section.
Figure 4:
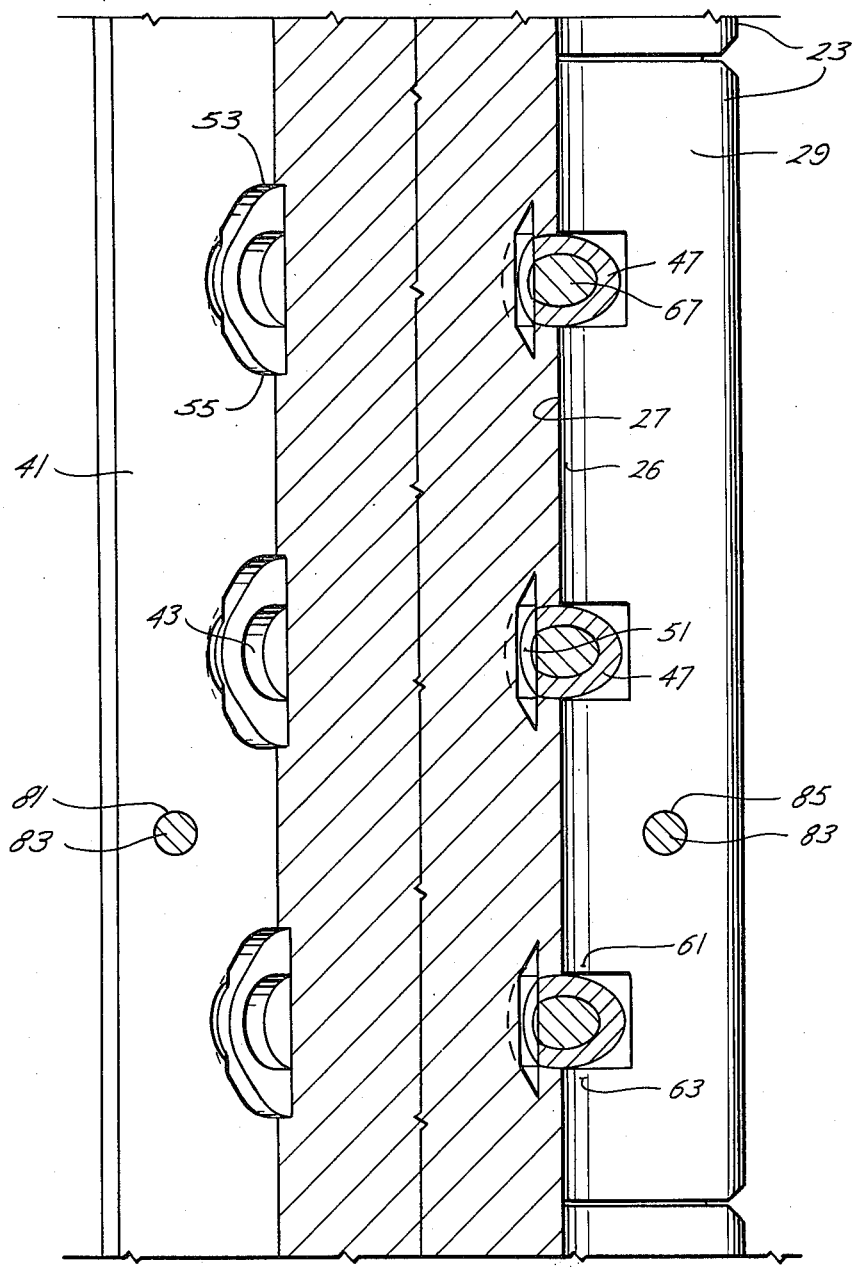
FIG. 4 is a fragmentary section taken on planes 4—4 of FIG. 2.

Referring now to FIGS. 2–4, each pad 23 is an elongated member or bar having a generally sector shape cross section forming a corner 25 having sides 27, 29 disposed substantially perpendicularly to each other, which if projected to their intersection form an apex angle of substantially ninety degrees. However, the actual point of the corner is rounded. The cylindric face 31 of each pad is concentric with the axis 33 of flow passage 17 rather than being centered at the apex of corner 25; for this reason the cross section is described as "generally" sector shaped.

Referring again to FIG. 1, as well as FIGS. 2 and 3, the face of each pad is provided with a plurality of tungsten carbide compacts 35 pressed into sockets in the pad. Any other form of wear resisting means may be employed for the face of the pad, e.g. as shown in the aforementioned Garrett U.S. Pat. No. 3,818,999, or the pad may merely be made of hard metal or even left unprotected so as to ablate in use. It is to be understood that except for the inserts, all parts of the disclosed stabilizer are preferably made of steel.

Each arm 21 is provided with a longitudinally extending V groove or flute 37 having sides 39, 41 disposed substantially perpendicularly to each other, which, if projected to their intersection form an apex angle of substantially ninety degrees. However, the actual bottom of each groove is rounded, but not as much in the corner of each pad, so that when a pad is positioned on an arm, the point of the corner of the pad does not touch the bottom of the groove.

To prevent longitudinal motion of each pad relative to the body, each arm is provided with a plurality of generally cylindrical radial sockets 43 in register with a plurality of generally cylindrical radial sockets 45 in the corners of the pad. In each registering pair of sockets 43, 45 is disposed a radial dowel pin 47. Each radial dowel pin 47 has a pair of lugs 49, 51 received initially in vertical slots 53, 55 adjacent socket 43 and then, after the dowel pin has been turned 90°, disposed in slots 57, 59. The lugs hold the radial dowel pin against radial outward movement. The portions 61, 63 of the pad corner above and below each socket 45 in the pad enter the slots 53, 55 in the arm and prevent the radial dowel pin from turning.

Each radial dowel pin has a threaded bore 65 receiving the threaded stem 67 of one of the cap screws 25. Radial dowel pins 47 may therefore be called dowel pin-nuts. Each cap screw stem 67 extends through the small diameter portion 69 of a stepped bore 71 in the face of the pad. Cap screw head 73 bears against the step formed at the juncture of the large and small diameter portions of the bore so that when the screw is tightened it draws the pad radially toward the body. Preferably the tolerances are set so that the apex angle of each pad corner is always slightly greater than the apex angle of the flute, and reliance is placed on the cap screws to bring the sides of each pad corner into engagement with the receptive flute.

Figure 6:
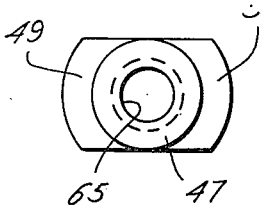
Figure 8:
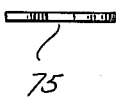
Figure 10:
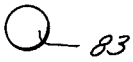

Each cap screw is secured against radial outward motion by a retainer ring 75 received in an annular groove 77 in the large diameter part of stepped bore 71. As best shown in FIG. 6, each ring 75 is split at one side and provided with a pair of openings or eyes 77, 79 to receive a tool for drawing the ends of the ring together so the ring diameter will be small enough to allow insertion through bore 71 to a position adjacent groove 77. The resilience of the ring is such that upon release of the tool the ring springs into groove 77. The ring is wider than the depth of the groove so that the inner periphery of the ring extends over the head of the cap screw and prevents it from coming out of the pad.

Referring now particularly to FIG. 4, as well as the other figures, in the lower part of side 41 of each flute, between the levels of the middle and lowermost radial dowel pins there is a cylindrical socket 81 in which is disposed a lateral cylindrical dowel pin 83. In the lower part of side 29 of each pad is a cylindrical socket 85 adapted to receive the portion of lateral dowel pin 83 that protrudes from socket 81 in the side of the flute. Since the sides of the flute are substantially perpendicular, as are the sides of the corner of the wear pad, one side of the pad can be slid along one side of the flute until the other side of the pad engages the other side of the flute, and the lateral dowel pin in such other side of the flute will be in register with and enter the socket in such other side of the pad.

If desired the lateral dowel pin can initially be placed in the pad and enter the socket in the side of the flute as the pad is slid into position. The lateral dowel pin makes a close fit with its sockets in the pad and body so as to take shear loads and thereby supplement the radial dowel pins. Because the latter do not make such close fits with their sockets, due to tolerances required in manufacturing, the one lateral shear pin may take as much load as the three radial dowel pins combined. It will be understood that the closest fitting dowel pin, which is the lateral pin, will usually have to be strained somewhat before one of the radial dowel pins will even begin to take shear load.

Nevertheless, each lateral dowel pin makes a loose enough fit with its sockets such that it can be removed by hand, or pulled out with a pair of pliers. In other words, the fit is a close fit but preferably not an interference fit.

Each pad is assembled to the body by first inserting the radial dowel pin-nuts into the body and turning them so the lugs are perpendicular to the body axis. Then the pads are slid into position with the lateral dowel pins in engagement with their sockets. Next the cap screws are screwed into the radial dowel pin-nuts and tightened. Finally, the retainer rings are installed over the cap screws. The reverse procedure is followed when a pad is to be removed for replacement. At the same time other parts, such as lateral dowel pins, radial dowel pin-nuts, cap screws, and retainer rings, if worn out, may be replaced.

As long as the retainer rings are in position, the cap screws cannot come out of the pads and the lateral dowel pins prevent the pads from coming out of the flutes, so that the assembly is positively locked together.

One of the advantages of the invention, in addition to those previously set forth, is that the pads are positively retained in place on the stabilizer arms even if the heads of the cap screws break off. The retainer rings keep the heads in the pad and the heads prevent the cap screw stems from moving axially in the pads. Since the pads are held to the arms by the lateral dowel pins, the cap screw stems cannot unscrew from the dowel pin-nuts and the assembly stays together. When it comes time to replace the pad, the cap screw stem can be removed by boring a hole in its and removing the stem with a back-out tap. Preferably, an overshot type tool comprising a helical wire spring suitably mounted on a Tee shaped handle is employed to remove such broken cap screw stems. The coil can be screwed onto the reduced diameter unthreaded part of the cap screw stem and then turned oppositely to tighten it on the cap screw stem and finally to unscrew the stem from the dowel pin-nut. If the cap screws have right hand threads, the removal tool spring will be a left hand helix.

Summarizing, there is provided a stabilizer having three or more arms, each with a wear pad extending longitudinally at the outer end of the arm. Each pad is secured to an arm by flute and corner means comprising a ninety degree corner on the pad received in a 90° flute in the arm, radial dowel pins bisecting the ninety degree angles of the flute and corner and extending radially relative to the flow axis of the tubular body of the stabilizer, bayonet joint means releasably holding each dowel pin to the body comprising lugs on the dowel pin entering slots in the body and then turned into recesses at each side of the slots, cap screws passing through stepped bores in the pads into threaded sockets in the radial dowel pins, releasable resilient, split retainer rings received in annular grooves in the stepped bores to overlie the cap screws, and a lateral dowel pin across the interface between one side of each pad corner and arm flute, the lateral dowel pin extending perpendicularly from a side of the flute into a registering socket in the corner of the pad, both sockets having axes perpendicular to the interface.

While a preferred embodiment of the invention has been shown and described, modifications can be made by one skilled in the art without departing from the spirit of the invention.

I claim:

1. Wall contacting tool comprising a body and a wear pad, said body and pad having correlative flute and corner means extending along the body preventing relative motion of pad and body transverse to the length of said means except outwardly from the apex of the corner, screw means extending through the pad into a screw socket carried by the body to prevent relative motion of pad and body outwardly from the apex of the corner, the axis of said screw means bisecting the apex angle of the corner and flute, said apex angle being ninety degrees, releasable retention means preventing relative motion of said screw means and pad along the bisector of said apex angle, and dowel means extending between one side of said flute means and the adjacent side of said corner means, said dowel means preventing relative motion of said pad and body parallel to the length of said flute and corner means and further preventing relative motion of said pad and body outwardly from the apex of said flute and corner means.

2. Tool according to claim 1 wherein the interface between the other side of the flute means and the other side of the corner means is planar, being free of any dowel means thereacross, whereby when said releasable retention means is released and said screw means is removed, said pad can be moved parallel to said other side of the flute and corner means interface.

3. Tool according to claim 2, said screw pocket carried by the body being a nut releasably engaged in a slot in said body, there being a plurality of said screw means and screw sockets spaced apart along said length of the flute and corner means, said dowel means comprising for each pad a single pin between the lowermost two screw means.

4. A drill string stabilizer comprising a tubular body having a plurality of longitudinally extending arms, each arm having a flute extending longitudinally thereof at its outer periphery, the sides of each flute being planar and disposed perpendicularly to each other with the plane bisecting the angle between the sides of the flute being radially disposed relative to the axis of the tubular body of the stabilizer, a plurality of dowel pin sockets in each arm along the length of each flute each disposed with the socket axis bisecting the angle between the sides of the flute and radially relative to the axis of the tubular body of the stabilizer, a pair of bayonet slots extending from each dowel pin socket, a radial dowel pin having a pair of lugs adapted to be received in said bayonet slots and turned into position preventing withdrawal from the socket, each radial dowel pin having a threaded bore, a plurality of wear pads, each pad having two planar sides disposed perpendicularly to each other and a cylindric outer face therebetween extending the length of the pad, a plurality of said pads being disposed end to end in each flute, a plurality of stepped bores in each pad in register with said dowel pins, a cap screw in each stepped bore with its threaded stem screwed into the threaded bore of the respective radial dowel pin and having its head bearing against the step in the bore, an annular groove in each stepped bore just outwardly from the cap screw head, a retainer ring in each said annular groove, a pair of registering sockets in one side of each pad and the adjacent side of the respective flute, and a lateral dowel pin in each said pair of sockets extending from one of said pair of sockets into the other of said pair of sockets preventing longitudinal movement of the respective pad relative to the arm and preventing radial outward movement of the pad relative to the arm, whereby said cap screws cannot come unscrewed from said radial dowel pins.

5. Wall contacting tool for use in rotary drilling comprising:

a tubular body and a replaceable external wear pad secured thereto by screw means extending transverse to the axis of the body and threaded aperture means receiving said screw means and connected to the body against rotation of the threaded aperture means relative to the body about the axis of the threaded aperture means, and means to prevent said screw means from unscrewing from said threaded aperture means comprising:

(1) releasable retainer means to prevent the screw means from moving axially relative to the pad but without preventing the screw means from turning about its axis, and (2) anchor means in addition to said screw means and out of contact therwith to prevent relative motion in the direction of the axis of the screw means between the pad and said threaded aperture means connected to the body, whereby upon loosening of said screw means complete release of said screw means from said threaded aperture means is prevented.

6. Tool according to claim 5 wherein said screw means retains said pad against translation radially outward from the axis of the tool and said anchor means comprises a pin extending between the body and pad transverse to the axis of the screw means and non-radially relative to the tool axis.

7. In replaceable wear pad for use with a wall contacting tool, such tool comprising a body having a Vee cross-section flute with an apex angle of at least ninety degrees whose bisector is radial to the tool axis, said pad having a Vee cross-section providing a corner adapted to fit in such a flute, said pad having a stepped bore bisecting the apex angle of the corner of the pad adapted to receive a cap screw to extend radially of the tool axis for securing the pad to the body with the head of the cap screw bearing against the step of said bore and engaging a threaded aperture in said flute connected to said body against rotation relative to the axis of said threaded aperture, the improvement in means for preventing said screw from unscrewing from said threaded aperture comprising:

(1) the larger diameter portion of the stepped bore having an annular groove about its inner periphery adapted to receive a resilient ring to retain such screw in such bore, and (2) at least one socket in one side of the corner of said pad adapted to receive a dowel pin to traverse the interface of said one side of the pad and an adjacent side of the flute of such body to prevent motion of said pad relative to said threaded aperture connected to said body in the direction of the axis of said bore, said socket having an axis transverse to the plane of the bisector of said apex angle of said corner whereby upon assembly of said pad to said body the axis of said bore will be non-radial relative to the axis of the tool, and whereby upon loosening of said screw complete release of the screw from said threaded aperture will be prevented.

* * * * *

UNITED STATES PATENT AND TRADEMARK OFFICE

CERTIFICATE OF CORRECTION

PATENT NO. : 4,280,742

DATED : JULY 28, 1981

INVENTOR(S) : DANIEL B. JUSTMAN

It is certified that error appears in the above—identified patent and that said Letters Patent is hereby corrected as shown below:

Column 2, line 60: change "DRAWING" to -DRAWINGS-.

IN THE CLAIMS:

Column 6, line 34: change "pocket" to -socket-.

Column 7, line 25: change "therwith" to -therewith-.

Column 8, line 4: change "Vee" to -V-.

Column 8, line 8: change "Vee" to -V-.

Signed and Sealed this

*Sixteenth* Day of *March 1982*

[SEAL]

*Attest:*

GERALD J. MOSSINGHOFF

*Attesting Officer*

*Commissioner of Patents and Trademarks*